US007150345B2

(12) United States Patent
Redzisz

(10) Patent No.: US 7,150,345 B2
(45) Date of Patent: Dec. 19, 2006

(54) DUAL COMPARTMENT TOOL BAG

(75) Inventor: Andrezj M. Redzisz, Wheeling, IL (US)

(73) Assignee: Travel Caddy, Inc., Elk Grove Village, IL (US)

( * ) Notice: Subject to any disclaimer, the term of this patent is extended or adjusted under 35 U.S.C. 154(b) by 0 days.

(21) Appl. No.: 10/786,814

(22) Filed: Feb. 25, 2004

(65) Prior Publication Data

US 2005/0029066 A1 Feb. 10, 2005

Related U.S. Application Data

(60) Provisional application No. 60/450,207, filed on Feb. 25, 2003.

(51) Int. Cl.
*A45C 3/00* (2006.01)
*A45C 13/10* (2006.01)

(52) U.S. Cl. ..... 190/111; 190/109; 190/112; 190/126; 190/904; 206/372; 206/373; 383/40; 383/41

(58) Field of Classification Search ..... 190/109–112, 190/803, 124, 126, 903; 150/117; 383/40, 383/41; 206/372, 373
See application file for complete search history.

(56) References Cited

U.S. PATENT DOCUMENTS

| | | | | |
|---|---|---|---|---|
| 1,711,349 | A * | 4/1929 | Howard | 190/111 |
| 2,332,757 | A * | 10/1943 | Roth | 190/111 |
| 2,334,895 | A * | 11/1943 | Bracken | 190/111 |
| 2,533,850 | A * | 12/1950 | Syracuse | 150/117 |
| 2,577,670 | A * | 12/1951 | Adams | 190/111 |
| 5,873,504 | A * | 2/1999 | Farmer | 224/576 |
| 6,126,003 | A | 10/2000 | Brouard | |
| 6,478,463 | B1 * | 11/2002 | Snider | 383/18 |
| 6,508,358 | B1 * | 1/2003 | Cheng | 206/315.1 |
| 2003/0209462 | A1 * | 11/2003 | Godshaw et al. | 206/581 |

* cited by examiner

*Primary Examiner*—Sue A. Weaver
(74) *Attorney, Agent, or Firm*—Banner & Witcoff, Ltd.

(57) ABSTRACT

A dual compartment, dual open mouth tool bag is fabricated from flexible material forming the side and top panels of the bag and the dual access openings. Each of the separate open mouth openings provides separate access to an individual compartment within the bag. The compartments may, in an alternative embodiment, be connected one to the other.

3 Claims, 4 Drawing Sheets

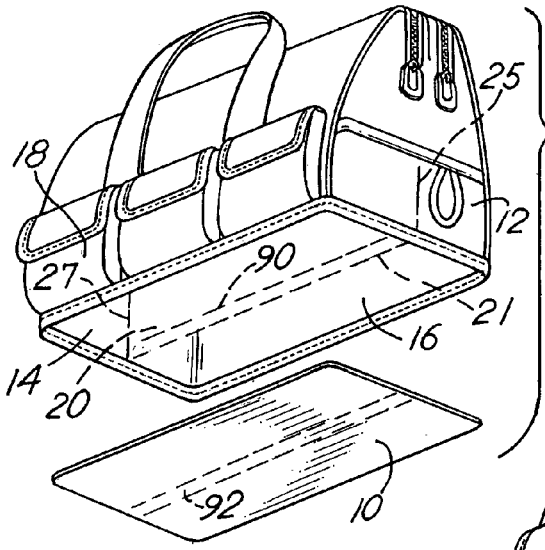
FIG.4
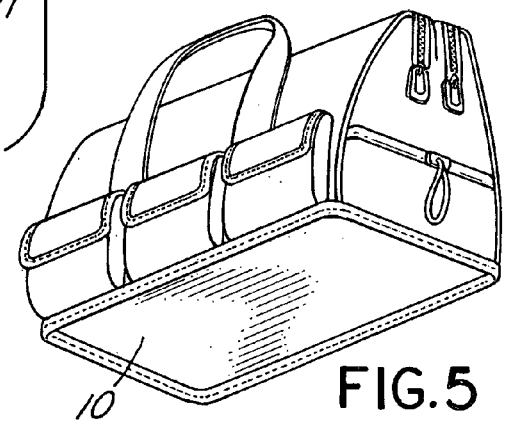
FIG.5
FIG.6
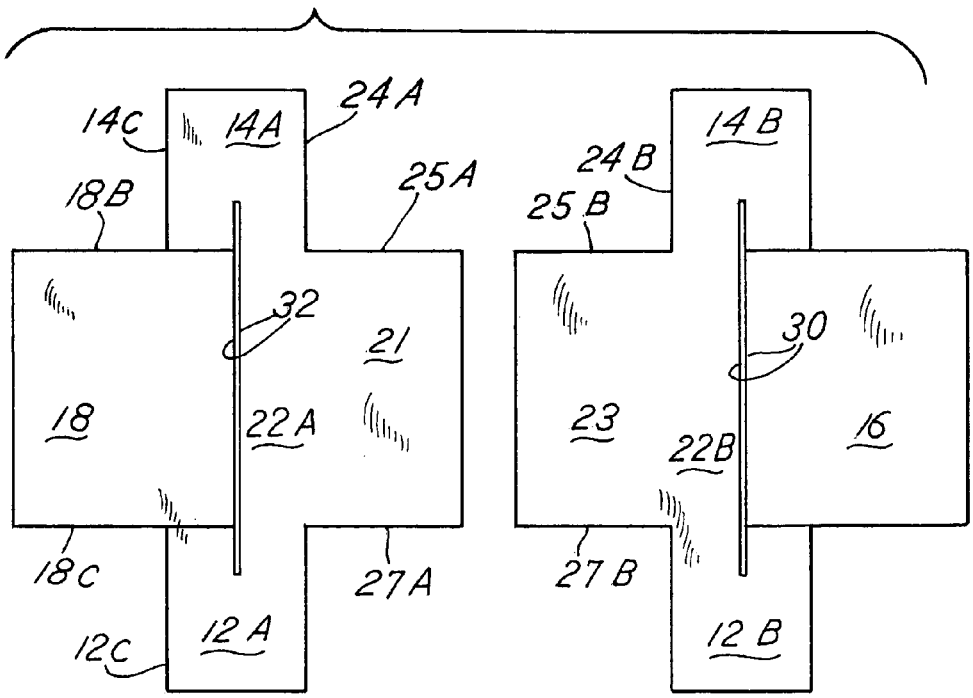

DUAL COMPARTMENT TOOL BAG

CROSS REFERENCE TO RELATED APPLICATIONS

This is a utility application based upon and incorporating by reference an earlier filed provisional application Ser. No. 60/450,207 filed Feb. 25, 2003 and entitled "Dual Compartment Tool Bag" for which priority is claimed.

BACKGROUND OF THE INVENTION

In the principal aspect the present invention relates to a tool bag and, more particularly, to a tool bag, which includes first and second generally parallel access openings in the top thereof.

Historically, tool bags have been limited to a single hinge top opening for access to a single interior compartment. The hinge opening, sometimes termed a "Gatemouth" opening, provides wide-open access to the contents of the bag. This style of bag construction has also been used for travel bags, medical bags, tool bags, legal and accounting document bags and handbags.

While such single mouth or single top entry bags are exceedingly useful, often their utility is diminished since the person using such a bag will not need to place all of their tools or items in a single compartment. Rather, it will be more convenient to have side-by-side, separated dual compartments. Thus, there has need for a dual compartment double-hinged opening case or bag.

SUMMARY OF THE INVENTION

Briefly, the invention relates to a soft sided bag having first and second generally parallel flexible open mouth access openings in the top of the bag wherein each of the separate openings connect to a separate compartment within the bag and further wherein the separate compartments may be joined or connected to expose the entire contents of the bag. Further, the invention contemplates the pattern of the material utilized to create the double, open mouth bag in that the configuration of various panels is disclosed as well as the manner in which the panels are connected either permanently or temporarily by means of a hook and loop fastener, for example. The bag has a generally rectangular rigid base whereas the sides of the bag are generally flexible and soft sided so that the dual open mouth construction of the bag is facilitated by the folding of the side panels and the joining thereof by a fastener mechanism such as a zipper or snap fasteners.

Thus, it is an object of the invention to provide an improved dual, open mouth bag construction which may be utilized as a tool bag, for example, wherein first and second adjacent compartments are provided within the bag each compartment accessible through its own individual, flexible, open mouth construction.

Yet another object of the invention is to provide an inexpensive, yet rugged and durable open mouth bag construction.

Another object of the invention is to provide a pattern for a dual open mouth bag construction wherein the pattern may be utilized to provide for a bag having permanently separated dual compartments or dual compartments which may be integrated one with the other in an easy and efficient manner.

These and other objects, advantages and features of the invention will be set forth in the detailed description which follows.

BRIEF DESCRIPTION OF THE DRAWING

In the detailed description, which follows, reference will be made to the drawing comprised of the following figures:

FIG. 4 is an exploded isometric view of the component parts forming the bag or case of the invention;

FIG. 5 is an isometric view of the bag of FIG. 4 in the assembled condition; and FIG. 6 is a pattern for the flexible fabric material forming the side and internal panels of the bag.

DESCRIPTION OF THE PREFERRED EMBODIMENTS

Figure 1:
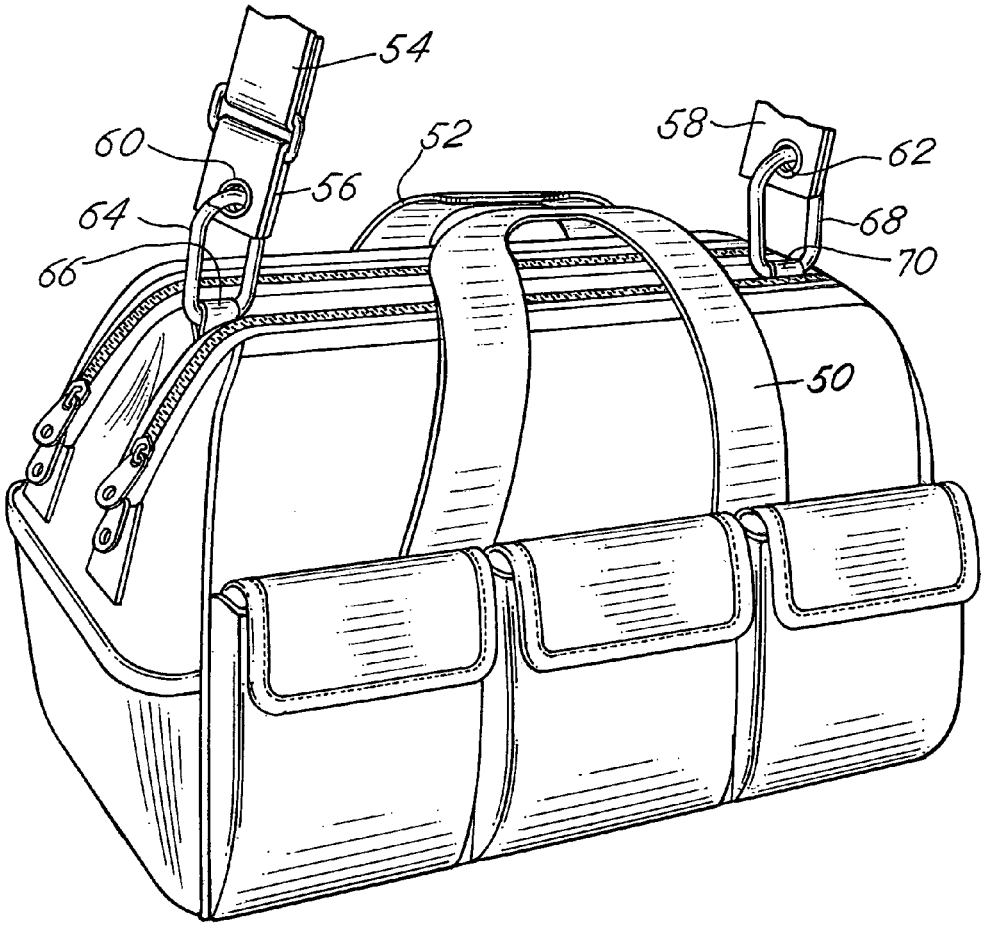
FIG. 1 is an isometric side view of a bag or case of the invention.
Figure 2:
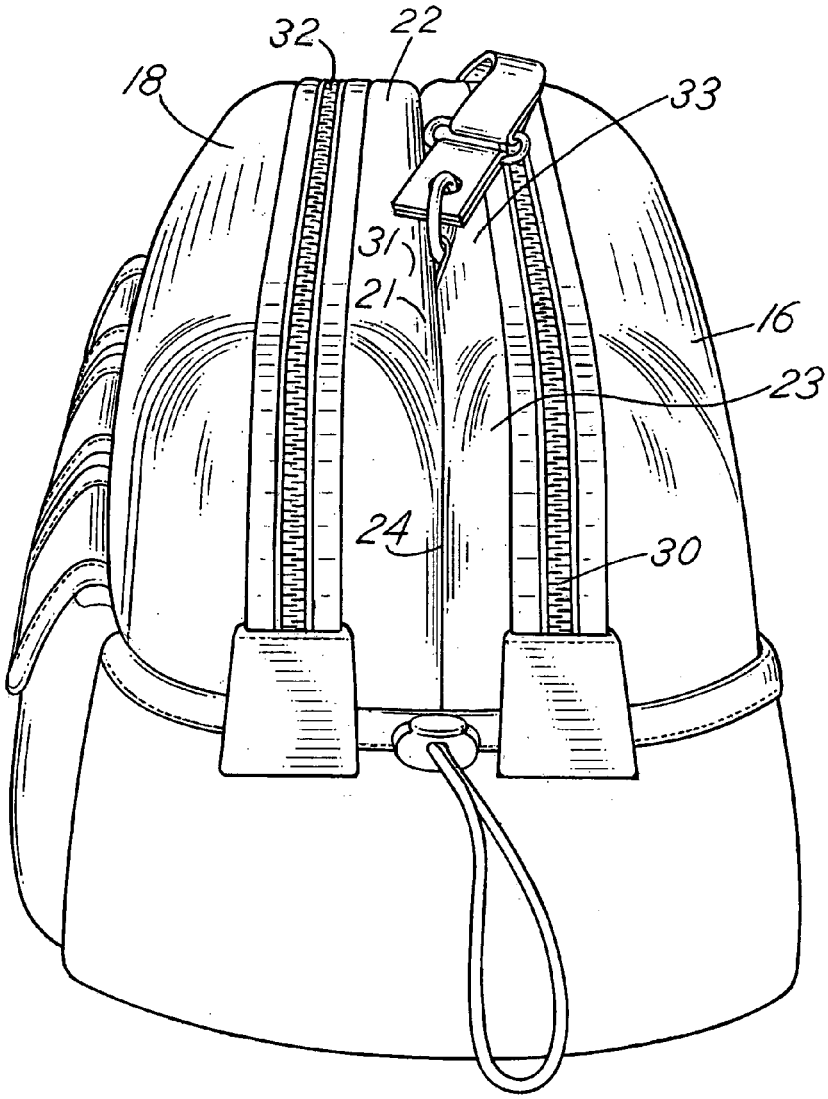
FIG. 2 is an isometric end view of the bag of FIG. 1.

The dual opening, two-compartment bag of the present invention has a multiplicity of potential uses. It may be used, for example, as a tool bag, a travel bag, a medical bag or a handbag. The design of the bag thus facilitates multiple potential uses.

Referring to the figures, the bag is a generally soft sided bag having a rigid planar flat bottom panel 10 as depicted in FIG. 4. The bag further includes first and second parallel opposite, spaced, end sides 12 and 14 and third and fourth parallel, opposite spaced lateral sides 16 and 18. The first, second, third and fourth sides are 12, 14, 16 and 18 are typically soft sided although each may be partially reenforced or made from a rigid or semi rigid material in their lower half joined to the bottom panel 10. The sides 12, 14, 16 and 18, as well as a mid-panel 20 referenced hereinafter, are all fabricated or sewn together from a canvas material or similar material prior to attachment to the generally rectangular, flat planar, bottom panel or side 10. Thus, as shown in FIG. 4 all of the component side parts of the bag are prefabricated separate and apart from the bottom panel 10. The bottom panel 10 is then sewn or attached to the sides 12, 14, 16 and 18 to form the bag as depicted in FIG. 5.

A feature of the invention is a dual layer, mid-panel, which is depicted in phantom as mid-panel 20 in FIG. 4. Mid-panel 20 is comprised of two layers or panels 21 and 23 of flexible fabric or material which respectively are opposed to one of the lateral side panels 16 and 18. The mid-panel layers 21 and 23 are sewn or attached together along seams which join lateral end edges 25 and 27. The mid-panel layers 21 and 23 which form the mid panel 20 join to end walls 12 and 14 and define a bridge or connecting sections 22A and 22B respectively therebetween. Thus, each mid-panel layer 21 and 23 provides a flexible flap sector 31 and 33 opposed respectively to the flexible top sector of lateral sides 18 and 16.

In practice, the pattern forming for the end panels 12 and 14 and side panels 16, 18, as well as mid panel 20 (i.e. layers 21, 23) is depicted in FIG. 6 wherein seam line 24 is indicated by edges 24A, 25A, 25B and 24B associated respectively with panel parts 14A, 22B and 14B. Side panel 18 is then sewn to panel sections 12A, 14A along seam line edges 12C/18C and 14C/18B. The mid panel 20 may be a separate panel piece or integral with sides 12 and 14 as depicted in FIG. 6.

Figure 3:
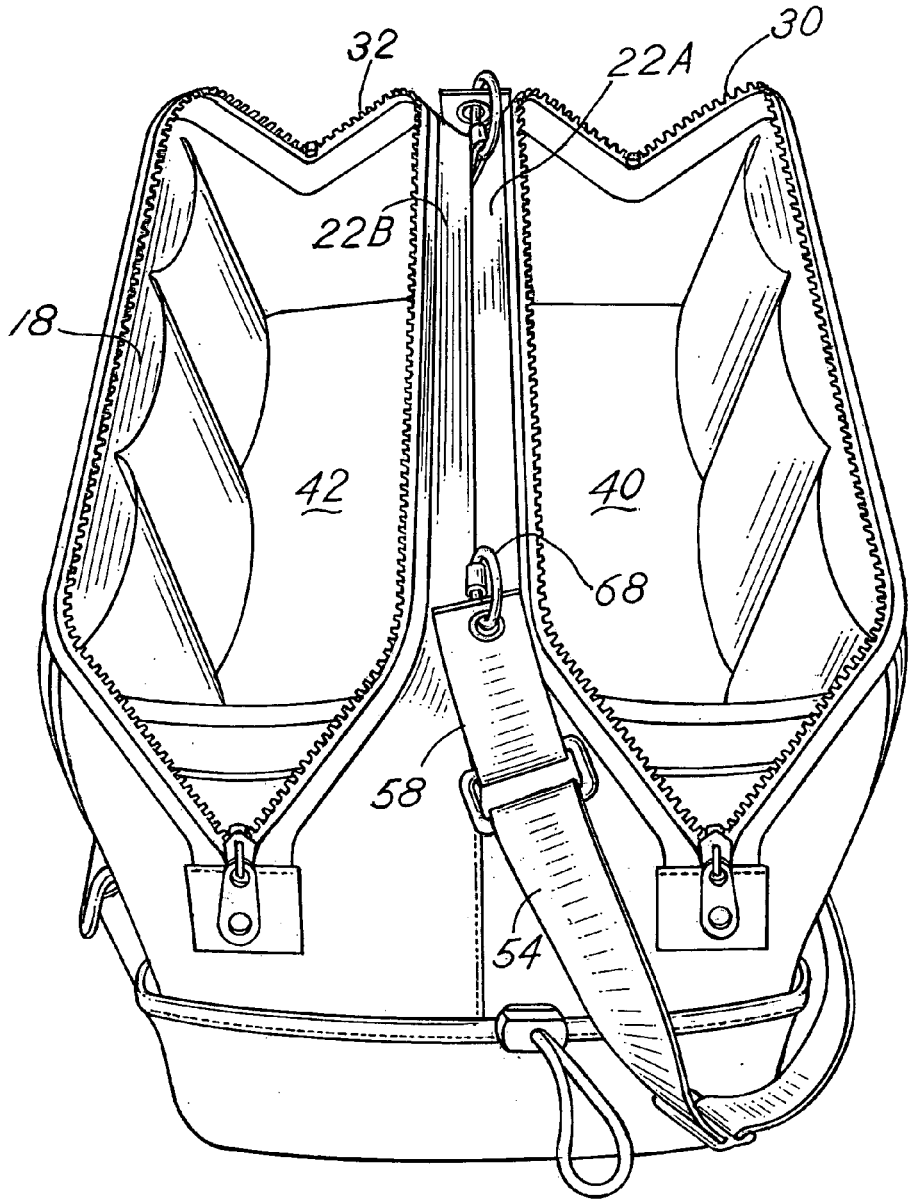
FIG. 3 is an isometric end view similar to FIG. 2 wherein, the two compartment openings for the bag are in the open position.

Thus, connecting segment 22 (22A, 22B) joins the mid section of the first and third wall 12 and 14 and further includes a center seam 24 (24A,24B) which is sewn or connected to the mid-panel 20 (i.e. layers 21, 23). The sidewalls 16 and 18 flexible side walls and are connected to the connecting segment 22A or 22C by means of zipper construction 30 and 32 respectively. As will be noted in FIG. 3 and FIG. 6 the connecting segment 22 comprises an extension of the first and third sidewalls 12 and 14. The zipper connection 30 joins the flexible sidewalls 16 and first and third end walls 12 and 14 with the connecting segment 22 to enclose a first compartment 40. In a similar manner, the zipper 32 joins the connecting section 22 with the first and third end walls 12 and 14 and the fourth sidewall 18 to form a compartment 42. The compartments 40 and 42 are separated one from the other by means of the mid-panel 20 (layers 21, 23) as depicted in FIG. 4.

The mid-panel 20 may be connectable to the bottom panel 10 and the end panels 12 and 14 respectably by releasable fasteners (e.g., 90,92 in FIG.4) and more particularly by a loop type fastener such as known by the trade name Velcro. In this manner, the mid-panel 20 may be disengaged to from the bottom wall panel 10, and the first and third end walls 12 and 14 to provide access to a connected set of compartments 40 and 42 defining a single compartment. Thus, the separate compartments 40 and 42 will be joined together to form a single compartment. Alternatively, the mid-panel 20 could be sewn in place as described previously to provide first and second separate compartments 40 and 42 for the bag.

Carry handle straps 50 and 52 are attached to the side panels 16 and 18. A shoulder strap 54 is provided and includes fabric and loops 56 and 58 each having eyelets 60 and 62 respectably. A carabineer 64 is provided through eyelet 60 for attachment to a fabric loop 66 sewn into the seam 24. Similarly, a carabineer 68 is provided to the eyelet 62 for engagement with a fabric loop 70 sewn in the seam 24 at the opposite end of the bag. The shoulder strap arrangement described provides significant adjustment for the strap to facilitate carrying of the bag.

Variations of the described bag may be provided as within in the scope of the invention. The invention therefore is limited only by the following claims and equivalents.

What is claimed is:

1. A two compartment bag comprising, in combination:

a generally flat, rectangular bottom panel with connected side edges;

first, second, third, and fourth adjacent, flexible material, side wall panels extending from and affixed seriatim to the side edges of the bottom panel to form an enclosure with an open top, said first and third wall panels affixed to side edges of said bottom panel and connecting said second and fourth side wall panels, said open top including first and second separate, parallel, top closures, said second side wall panel generally parallel to and spaced from the fourth side wall panel, said first and second separate top closures parallel to the second and fourth opposed, side wall panels; a connecting top panel segment comprised of an extension between the first and third side wall panels joining the first and third opposed side wall panels, said first and third side wall panels forming the opposite ends of said first and second top closures, and an internal panel generally parallel to the second and fourth side wall panels and extending from the connecting top panel segment to the inside of the first and third side wall panels and also to the bottom panel to form two separate internal sections of the bag enclosure, said internal panel comprised of a continuous flexible material extension of the top panel segment; said second and fourth panels, connected respectively by fastener mechanisms to the connecting, top panel segment to form said first and second closures.

2. The bag of claim 1 wherein the internal panel is attached to the bottom panel by releasable fastening devices.

3. The bag of claim 1 including a shoulder strap having opposite ends with fabric loops, a carabineer attached to each loop, and two fabric loops attached to the connecting segment, said carabineers attached to the fabric loops.

* * * * *